United States Patent [19]

Appleby et al.

[11] Patent Number: 5,037,005

[45] Date of Patent: Aug. 6, 1991

[54] INVERTED DISPENSER

[76] Inventors: Paul Appleby, 557 Melita Crescent, Toronto, Ontario, Canada, M6G 3Y7; Jerry N. Moscovitch, 59 Cowan Avenue, Toronto, Ontario, Canada, M6K 2N1

[21] Appl. No.: 508,492

[22] Filed: Apr. 12, 1990

Related U.S. Application Data

[63] Continuation of Ser. No. 257,488, Oct. 13, 1988, abandoned.

[51] Int. Cl.[5] ..... B67D 5/06; B65D 37/00

[52] U.S. Cl. ..... 222/184; 222/213; 222/215; 222/494

[58] Field of Search ..... 222/143, 173, 184, 185, 222/212, 213, 153, 215, 494

[56] References Cited

U.S. PATENT DOCUMENTS

| | | | |
|---|---|---|---|
| 2,540,842 | 2/1951 | Stanley et al. | 222/494 |
| 2,571,083 | 10/1951 | Witt | 222/184 |
| 2,758,755 | 8/1956 | Schafler | 222/212 |
| 3,012,698 | 12/1961 | Wiederquist et al. | 222/212 |
| 3,050,216 | 8/1962 | Norris | 222/184 |
| 3,054,535 | 9/1962 | Clarey | 222/215 |
| 3,063,601 | 11/1962 | Hertz | 222/215 |
| 3,078,016 | 2/1963 | Judy | 222/212 |
| 3,212,681 | 10/1965 | Weikert | 222/185 |
| 3,412,910 | 11/1968 | Hahn | 222/494 |
| 4,003,503 | 1/1977 | Aldridge | 222/173 |
| 4,168,020 | 9/1979 | Benson | 222/207 |
| 4,349,134 | 9/1982 | Schuster et al. | 222/212 |
| 4,394,939 | 7/1983 | Thor et al. | 222/207 |
| 4,402,431 | 9/1983 | Wiegner et al. | 222/207 |
| 4,420,101 | 12/1983 | O'Neill | 222/494 |

*Primary Examiner*—H. Grant Skaggs

*Attorney, Agent, or Firm*—Ridout & Maybee

[57] ABSTRACT

A hand holdable, disposable dispension container of low cost construction, generally of plastic, for the dispensing of fluent, generally viscid materials, including processed foodstuff such as ketchup, relish, mustard and jams; creams, handcreams, lotions, colloidal solids such as toothpaste and the like, has a base portion on which the container is free standing, and a valved dispensing outlet located on a lower side face of the container, in underhung protected relation adjacent to the base, to permit downward dispensing of selected quantities of the contents without having to resort to invention of the container. The container incorporates a self-venting pressure balance capability. The container content is always located in the lower part of the container, due to the influence of gravity for immediate dispensing, by squeezing of the container walls, and making possible the dispensing of substantially all of the contents so that virtually none is wasted and thrown out with the container.

11 Claims, 4 Drawing Sheets

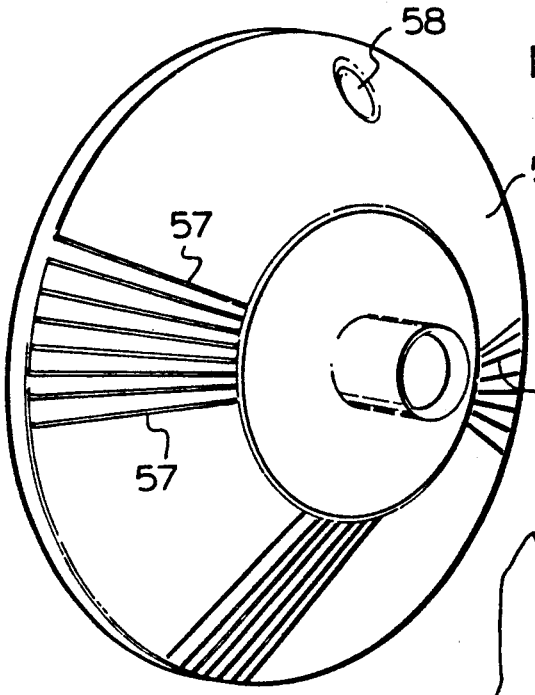
FIG.10.
FIG.11.
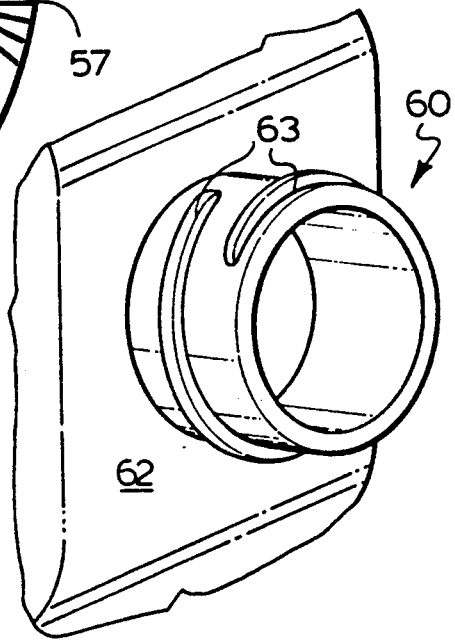
FIG.12A.
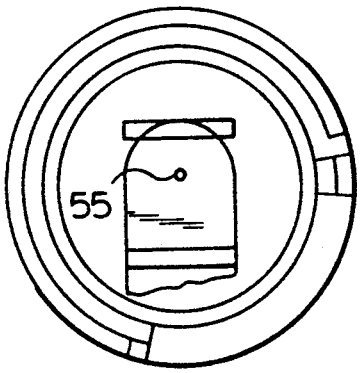
FIG.12B.
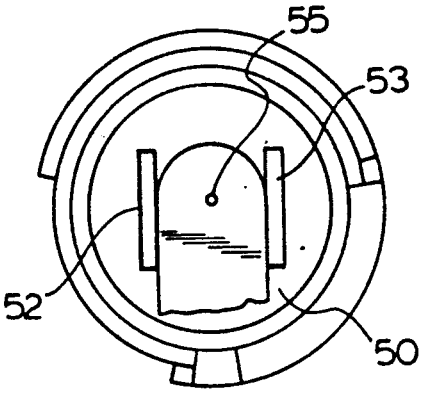

INVERTED DISPENSER

This application is a continuation of application Ser. No. 07/257,488, filed Oct. 13, 1988, which has been abandoned.

FIELD OF THE INVENTION

This invention is directed to a disposable, soft walled, hand held dispensing container suitable for use with foodstuff, condiments, creams and other materials.

BACKGROUND TO THE INVENTION

In the vending and utilization of many products, particularly where the product is repeatedly dispensed in small, variable quantities, the form of packaging has a great influence on the buyers, and on the buyers utilization of the product.

In the case of certain soft commestibles such as jam and honey, one very successful container has comprised a plastic container of a size and form suitable for being held in the hand of a user, the container having a removable screw top for inserting product therein, the screw top having an upwardly projecting small dispensing lipped aperture with a pivoted closure cap, for use by a user in dispensing a desired quantity of the contents.

In use, the cap is generally pivoted to an open position, clear of the dispensing aperture. The container is then inverted, to assist the viscid contents to flow under the influence of gravity in covering relation downwardly over the inlet to the dispensing aperture Manual compression of the container walls then expresses a desired quantity of the contents through the dispensing aperture under a build-up of internal air pressure above the contents, within the container. Cessation of the applied manual pressure then terminates flow of the container contents, so that the container can be returned to an upright position, and the dispensing aperture recapped.

One of the main drawbacks of such prior art containers is the time delay required, subsequent to inverting the container, before dispensing can actually take place, during which time the viscid contents are required to flow from one end of the container to the other under the influence of gravity, or else the air contents initially located above the product transfers as a bubble, to the upper side of the product, on inversion of the container. In any case, the delay is inconvenient, and can encourage users to shake the container in order to accelerate the contents reversal, sometimes with unpleasant results such as contents spillage or uncontrolled expulsion.

A further drawback to this type of prior art arrangement is the hardening of contents, due to agitation and mixing with the air present within the container, which can impede opening of the closure cap, while creating an undesirable quantity of fouled product.

In the case of screw cap containers of the prior art, the container lip can become fouled with the product. The container contents that become deposited on the screw cap or lid inner surfaces and in the container thread bands are difficult and time consuming to remove, and become stale and oxidized, and in the case of some products, become unpleasantly odorous. All of the contents cannot be readily dispensed, with consequent wastage, upon disposal of the container.

Also known in the prior art are containers containing a hand pump. These leave contents in the bottom of the container that are impossible to dispense and are inclined to be messy. Such containers are difficult to pack for travelling.

In the case of invertable containers having enlarged closure caps with flat heads, upon which the container can be stood in an inverted position, such containers are known for use with hand creams, hair shampoos and conditioners, and in the case of the PEARL DROPS product, with a dentifrice.

The tubular containers generally having a cylindrical cap may be stored horizontally or in an inverted position upon their caps. In the horizontal position the benefits of inversion are lost.

The PEARL DROPS container, having an inverted cone cap, may be stored in either inverted or upright positions, and thus can readily sacrifice the benefits of inversion. Reversal of a container to an upright position substantially negates the benefits of inverted storage.

The closure caps of these prior dispensers require to be removed in order for the product to be dispensed. Being screw caps, this requires the unscrewing of the cap, which frequently impells the user instinctively to return the container to an upright position, thus sacrificing much of the benefits of container inversion.

The screw cap closures are inconvenient to access in the inverted condition, while there generally is difficulty in viewing the progress of the initial flow of the contents during dispensing.

SUMMARY OF THE INVENTION

In accordance with the present invention there is provided a handheld, free standing container for the selective dispensing of product, wherein the container is permanently inverted, having an access in air sealing relation located on a lower side face of the container over which the contents dispose themselves, under the influence of gravity.

Valve means are provided for the passage of contents from the container in dispensed relation therethrough.

The preferred container embodiment incorporates an air venting valve means, for admitting atmospheric air within the container subsequent to the dispensing of product therefrom. Upon release of the container walls from a laterally compressed condition, subsequent to dispensing product, the walls return to their original shape and induce a flow of air inwardly through the venting valve, into the container. Thus, air in-flow is induced by the elastic condition of the container walls, which are expanded outwardly as a consequence of the "memory" of the plastic, subsequent to having been squeezed inwardly in a product dispensing operation. The increase in internal volume induces air to fill the space, substantially to atmospheric pressure.

In a first embodiment the present invention provides a handholdable, disposable dispensing container for the dispensing of fluent material, having a base portion to support the container in free standing relation so that the material is concentrated by gravity, at the lower end hand squeezable wall portions, and a valved outlet at a lower portion of the container, normally submerged beneath the surface of the contents of the container, in use to facilitate downward dispensing of the fluent contents therethrough, upon compressing of wall portions of the container.

The upper wall portions of the preferred embodiment are so shaped to preclude free standing thereon of the container, to ensure storage of the container in free standing relation upon its base, so that the contents are predisposed for dispensing.

The preferred embodiment container is shaped to fit comfortably to the hand, for ready squeezing of the main walls within the grasping hand.

The subject closure means in one embodiment is removable. In a further embodiment the subject filler closure means constitutes a permanent portion of the container, in sealed relation therewith, generally being sealed to the container subsequent to the insertion of container contents therein.

In a further embodiment valve means are provided for the access of air to the interior of the container. These air valve means function generally as a non-return valve, wherein a flow of air is induced into the interior of the container upon releasing of the container walls in mutual expanding relation, subsequent to a product dispensing operation therewith. Upon further gripping of the container walls in compressing relation, the air valve functions in a non-return mode, so that the interior of the container becomes pressurized as a consequence of being squeezed.

The subject container conveys a number of advantages over former prior art containers, such as: greatly enhanced convenience for dispensing product; improved dispensing control, including ready viewing of product as it emerges from the container; low cost, simple container construction; minimized disturbance of product, unless desired; minimal product wastage and contamination; optimized product recovery; and facilitated or inhibited container re-use.

In addition to the aforementioned features certain further aspects of container construction can include: construction of container outer surfaces to preclude free standing storage other than in a desired container orientation, for readiness in dispensing; the provision of a see-through wall portion or area of the container, for viewing the level of contents in the container; location of the dispensing nozzle on a side underface of the container, possibly downwardly inclined at an angle such as 45° to afford a clear view of the dispensed material, while protecting the outlet zone by overhang of the adjacent container portions; the configuring of the internal base surface of the container, to be inclined towards the container outlet at an angle of inclination, generally at least equal to the angle of repose of the most viscous fluid for which the container is intended to be used; the provision of a depending, supporting heel portion external to the container inclined interior base wall, to position and support the interior base surface at the desired angle of inclination, referred to above. The supporting heel may comprise an external slip-on, a blow-molding with a seam permitting separation or be suitably welded or glued to the container.

Certain desired characteristics of the discharge valve means comprise:

a resilient check valve, responsive to container internal pressure to permit passage of content outwardly therethrough;

utilization of a simple, resilient cantilever closure possessing plastic memory; or an equivalent multi-arm suspension;

being substantially self-closing on termination of container pressurization;

locking means provided to positively lock the closure means in sealing relation with the container; and finger grip means to facilitate grasping of the locking means by a user.

In addition to the form of container of the preferred embodiments, other embodiments are contemplated which are described as: (a) truncated wedge shape; and (b) a rectangular shape with angular protrusion. Additional shapes may be adopted in accordance with the present invention, having shapes categorized such as: rectangular shape with truncated angle; rounded wedge shape; tapered juke box shape with angular protrusion; rounded wedge-like shape; and snail shape.

BRIEF DESCRIPTION OF THE DRAWINGS

Certain embodiments of the invention are described, purely by way of indication, and not in any limited sense, reference being made to the accompanying drawings, wherein:

FIG. 10 is a general view showing the valve actuator for engaging and disengaging the container valve means;

FIG. 11 is a detail of one embodiment of a container neck by which an outlet valve is mounted;

FIG. 12A shows a detail of the valve closure and guide elements, with the valve in a closed condition; and, FIG. 12B is a like view with the valve in an open condition.

DETAILED DESCRIPTION OF THE EMBODIMENTS OF THE INVENTION

Figure 1:
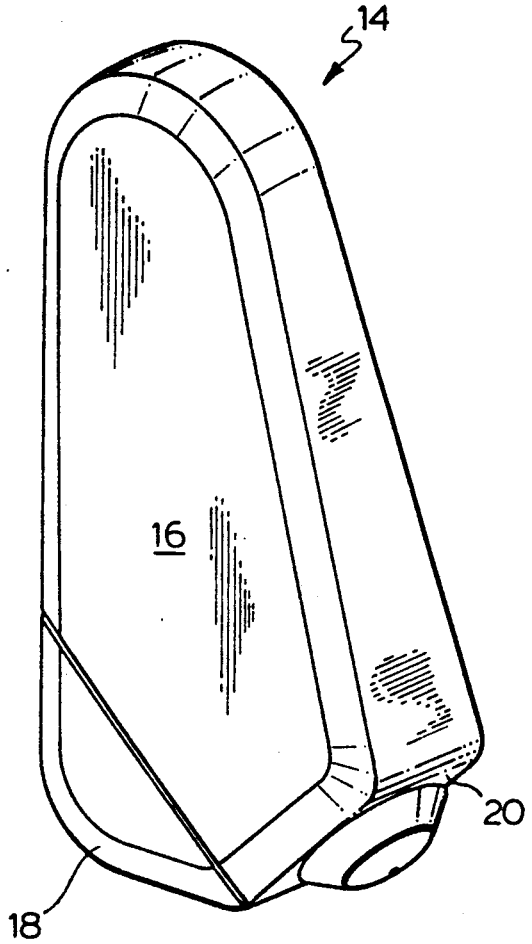
FIG. 1 is a general view of a container first embodiment in accordance with the present invention.
Figure 2:
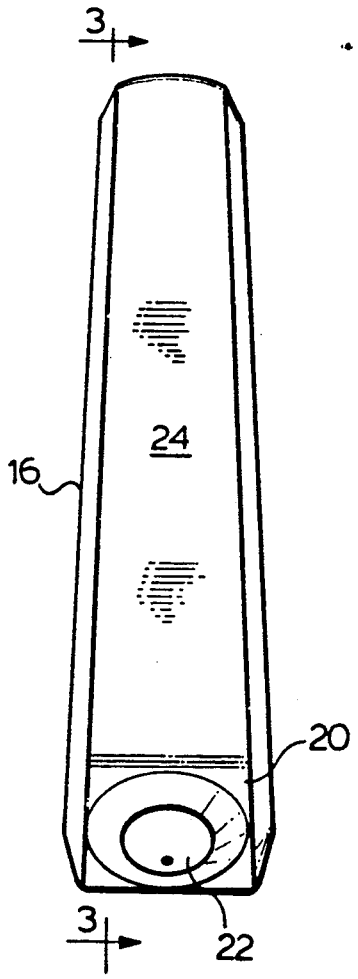
FIG. 2 is a side elevation of the subject first embodiment.
Figure 3:
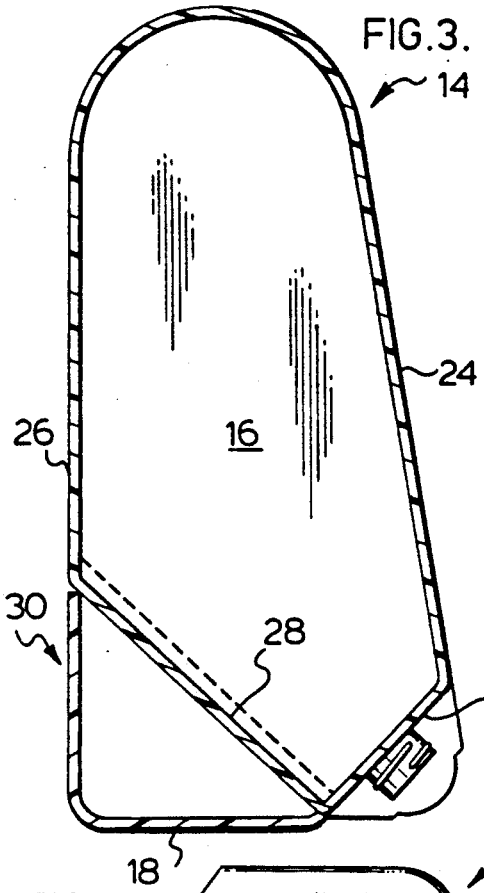
FIG. 3 is a sectional elevation taken at 3-3 of FIG. 2.

Referring to FIGS. 1, 2 and 3, the container 14 has main walls 16, a base portion 18 and an upwardly and forwardly inclined side wall portion 20 wherein a flow control valve 22 is located.

Details of valve 22 have been omitted from FIG. 3.

Figure 3A:
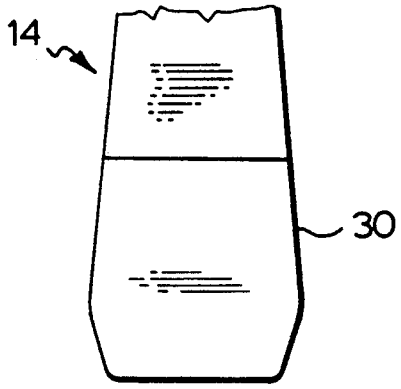
FIG. 3A is a partial rear end elevation of the first embodiment.

An upper side wall portion 24 connects with side wall portion 20 and main walls 16. Side wall 26 and inclined interior wall 28 complete the container 14. An externaly secured heel portion 30 contributes stability, to enable the free standing of container 14. The heel portion 30, seen more clearly in FIG. 3A, may snap on, or be glued or welded to the container 14, or be blow-molded as part of the container.

Figure 4:
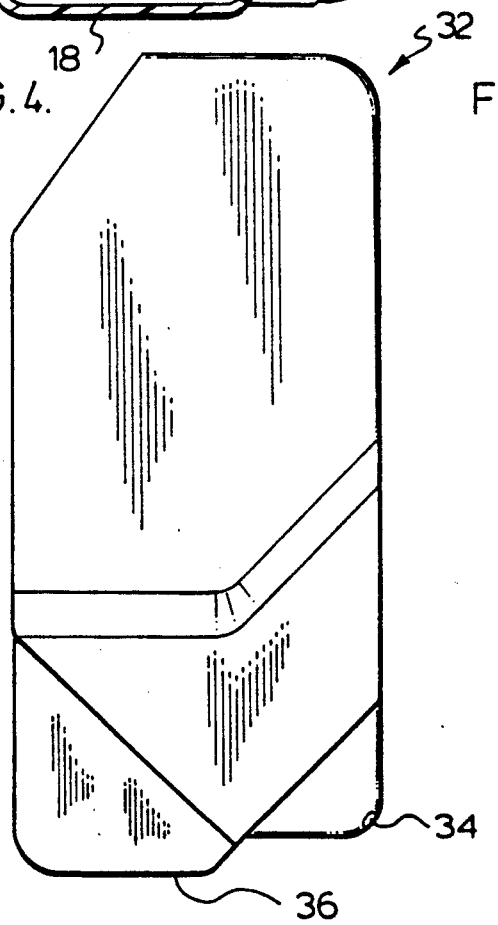
FIG. 4 is a front elevation of a second embodiment.
Figure 5:
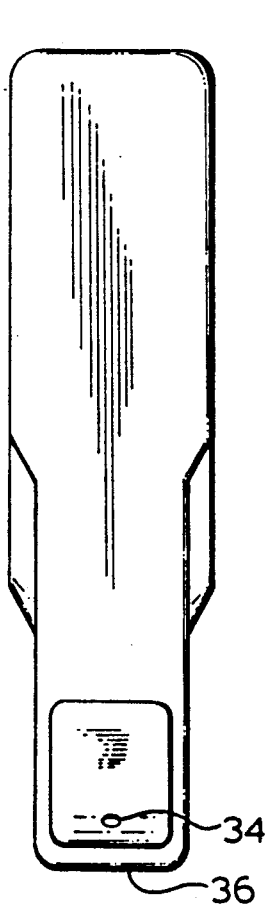
FIG. 5 is a side elevation of a second embodiment.

Referring to the FIGS. 4 and 5 embodiment the container 32 has a characteristically slender form to facilitate one-handed gripping and squeezing of the container main walls. The valve outlet 34 is relieved above the base 36, so as not to contact a supporting surface on which the container stands.

Figure 6:
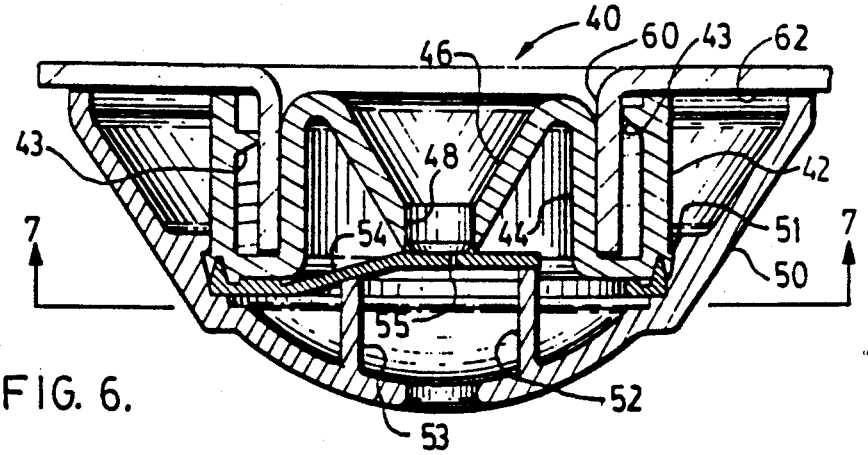
FIG. 6 is a diametrical cross section of a dispensing nozzle embodiment for the subject inverted containers.

FIG. 6 is a diametrical section of a valve 40 embodiment for the subject invention, shown in the closed condition. FIG. 11 shows a detail of a threaded neck embodiment 60, of a container aperture, set in container inclined side wall portion 62, by means of which the subject valve 40 can be attached. The valve 40 has a central barrel portion 42 internally threaded at 43 to engage the threads 63 of neck 60 (of FIG. 11).

A closure 44 of cylindrical form closely engages the interior of neck 60. A conical funnel portion 46 terminates at outlet aperture 48.

Figure 7:
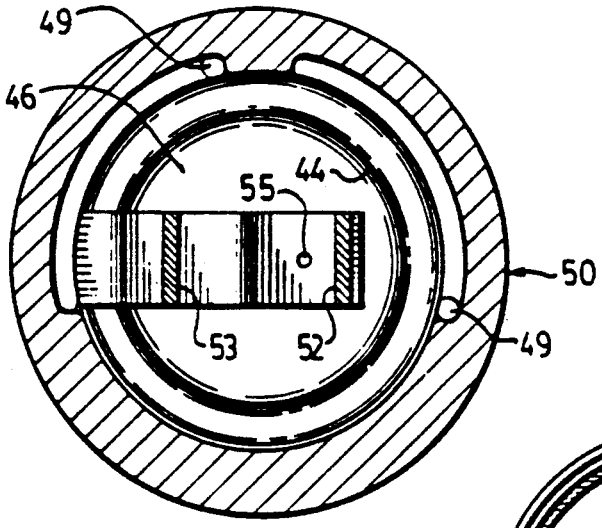
FIG. 7 is a section taken at 7—7 of FIG. 6.

A domed cap 50 encloses the valve 40, in rotatable engaging relation with shoulder portion 51. Referring to FIG. 7 stop pins 49 limit the rotation of cap 50. The cap 50 has a pair of parallel abutment plate portions 52, 53, to engage cantilever spring 54 when valve 40 is secured in the closed condition as shown in FIG. 6. Spring 54 is secured by cap 50 to the valve 40. In the open condition for valve 40, shown in FIG. 12B, the plate portions 52, 53 serve as guides for the valve spring 54, which is formed of a suitable plastic such as DELRIN (TM) and constitutes the valve closure element also. An aperture 55 in spring 54 serves as an air inlet relief valve being generally covered with the product to be dispensed. The plate portions 52, 53 serve to confine and guide the product as it is dispensed, with the valve 40 in an open condition.

On the application of manual compression to main walls 16, 16, of container 14 internal pressure thus generated deflects spring 54 between the abutment plates 52, 53 as shown in FIG. 12, thus displacing the spring 54 and annular closure ring 57 thereof clear of its seat, to permit the downward flow of container contents past the spring 54, between plates 52, 53 and out through the aperture 55.

Figure 8:
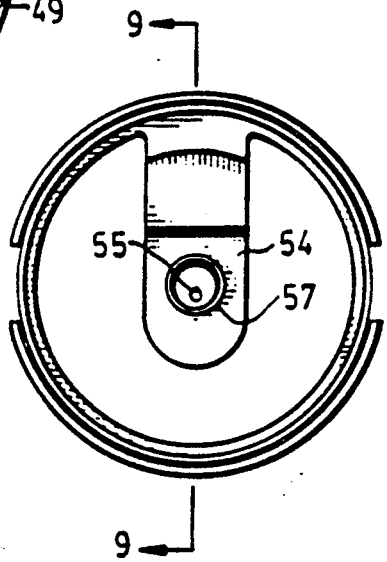
FIG. 8 is a detail of the valve element member of FIG. 7.
Figure 9:
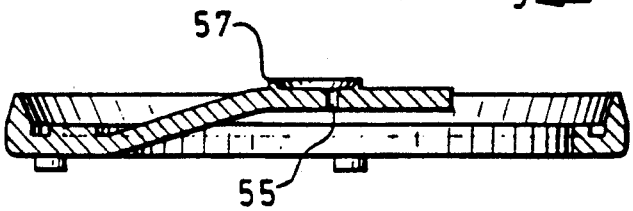
FIG. 9 is a diametrical section at 9—9 of FIG. 8.

Referring to FIG. 8, the cantilever spring 54 is carried by annular ring 56, seen in section in FIG. 6. The spring closure 54 has an annular closure ring 57 by which the outlet aperture 48 of valve 40 is sealed. Rotation of domed cap 50 brings abutment plate portions 52, 53 beneath the spring closure 54 to prevent any opening motion of spring 54 and closure ring 57 from off its seat.

In operation, rotation of cap portion 50 through 90° displaces the abutment plate portions 52, 53 to the sides of spring closure 54. This leaves spring closure 54 free to deflect, in opening relation of the valve 40. Upon the application of manual compression to the main walls 16 the container 14 is pressurized, initiating expulsion of the contents, between abutment plates 52, 53 to exit opening 55.

The wall portion 56 of FIG. 10 has a plurality of linear indentations 57 molded therein, to give a finger grip for rotating the valve portion 50 to the valve-open condition or to the valve-closed condition. Also shown is a visual cue 58.

A vent aperture 55 in spring 54 serves as a valve to admit atmospheric air upon release of the container walls 16, at which time the elastic memory of the container tends to restore the walls 16 to their original, uncompressed state. This induces an inward flow of atmospheric air through the aperture 55, upwardly through the fluid product.

We claim:

1. Valve means for use with a pressurizable container having an aperture therein, comprising:

collar attachment means for securing the valve means to the aperture in the container;

aperture closure means providing an outlet aperture of limited cross sectional area; and deflectable valve means normally extending in a first position in sealing relation across said outlet aperture and movable away from the outlet aperture to a second, open position in response to pressure within the outlet aperture acting on the valve means, said deflectable valve means having at least one portion thereof serving as a spring to apply closing force thereto to move the valve means from said second position to said first position upon release of pressure within said outlet aperture, said valve disabling means comprising a pair of spaced abutments receiving a portion of said spring in cantilevered relation therebetween when in said first, withdrawn position, and in said second position having one of the abutments positioned in pressing relation with the valve means, to secure the valve means in the first said position thereof.

2. The valve means as defined in claim 1, wherein said spring portion has a closure ring extending from a surface portion thereof.

3. The valve means as defined in claim 1, wherein said valve spring portion is comprised of resilient plastic.

4. The valve means as defined in claim 1, wherein said cantilevered spring portion has an aperture therethrough aligned with said container aperture to permit the inward passage of air.

5. A free standing compressible container for the selective manual dispensing of fluent contents, comprising:

a manually squeezable enclosure having main walls sealingly engaged to front and rear side walls converging upwardly to a curvate top portion, a first bottom wall inclining upwardly and forwardly having an aperture for the passage of fluent contents therethrough, sealingly engaged to the front side wall, and a second bottom wall inclining upwardly and rearwardly, sealingly engaged to the first bottom wall immediately beneath the aperture and sealingly engaged to a lower edge of the rear side wall; and a heel portion affixed to the enclosure having a base, a rear wall and main walls, the walls of the heel portion being aligned with and supporting the walls of the enclosure such that when the container stands on the base of the heel portion the enclosure is supported in a free standing position.

6. A container as defined in claim 5 wherein a longitudinal axis of the enclosure is substantially vertical.

7. A container as defined in claim 5 in which the container forms a truncated wedge shape.

8. A container as defined in claim 5 wherein the heel portion is removably affixed to the enclosure.

9. A container as defined in claim 5, including a valve means comprising a collar attachment means for securing valve means to the aperture in the container;

aperture closure means providing an outlet aperture of limited cross sectional area; and deflectable valve means normally extending in a first position in sealing relation across said outlet aperture and movable away from the outlet aperture to a second, open position in response to pressure within the outlet aperture acting on the valve means, said deflectable valve means having at least one portion thereof serving as a spring to apply closing force thereto to move the valve means from said second position to said first position upon release of pressure within said outlet aperture, aid valve disabling means comprising a pair of spaced abutments receiving a portion of said spring in cantilevered relation therebetween when in said first, withdrawn position, and in said second position having one of the abutments positioned in pressing relation with the valve means, to secure the valve means in the first said position thereof.

10. In combination, a manually squeezable enclosure having main walls sealingly engaged to front and rear side walls converging upwardly to a curvate top portion, a first bottom wall inclining upwardly and forwardly having an aperture for the passage of fluent contents therethrough, sealingly engaged to the front side wall, and a second bottom wall inclining upwardly and rearwardly, sealingly engaged to the first bottom wall immediately beneath the aperture and sealingly engaged to a lower edge of the rear side wall; and a heel portion having a base, a rear wall and main walls, the walls of the heel portion being aligned with and supporting the walls of the enclosure when the heel portion is affixed to the enclosure such that when the container stands on the base of the heel portion the enclosure is supported in a free standing position.

11. A container as defined in claim 10 wherein a longitudinal axis of the enclosure is substantially vertical.

* * * * *